United States Patent [19]

Lait

[11] Patent Number: 4,721,960

[45] Date of Patent: Jan. 26, 1988

[54] BEAM FORMING ANTENNA SYSTEM

[75] Inventor: Andrew J. Lait, Kanata, Canada

[73] Assignee: Canadian Marconi Company, Montreal, Canada

[21] Appl. No.: 886,182

[22] Filed: Jul. 15, 1986

[51] Int. Cl.[4] ..... H01Q 3/22

[52] U.S. Cl. ..... 342/368; 342/372

[58] Field of Search ..... 342/368, 371–374, 342/376

[56] References Cited

U.S. PATENT DOCUMENTS

| | | | |
|---|---|---|---|
| 2,817,084 | 12/1957 | Clapp et al. . | |
| 3,085,204 | 4/1963 | Sletten . | |
| 3,271,776 | 9/1966 | Hannan . | |
| 3,308,465 | 3/1967 | Tamana | 342/368 |
| 3,308,468 | 3/1967 | Hannan . | |
| 3,496,569 | 2/1970 | Alsberg et al. | 342/376 |
| 3,518,695 | 6/1970 | Schroeder | 342/372 |
| 3,731,316 | 5/1973 | Sheleg . | |
| 3,736,592 | 5/1973 | Coleman . | |
| 3,868,695 | 2/1975 | Kadak . | |
| 3,877,014 | 4/1975 | Mailloux . | |

OTHER PUBLICATIONS

Hansen R. C. (ed) Microwave Scanning Antennas (Academic Press 1964), vol . 1, Apertures , pp. 245–246; vol. III, Array Systems.

Rotman W. and Turner R. F., Wide-Angle Microwave Lens for Line-Source Applications, IRE Trans., AP-11, Nov. 1963, pp. 623–632.

*Primary Examiner*—Theodore M. Blum
*Assistant Examiner*—Gregory C. Issing
*Attorney, Agent, or Firm*—Fishman & Dionne

[57] ABSTRACT

A plurality of beam forming networks are connected to a plurality of antenna array elements. Each beam forming network has a plurality of output terminals equal to the plurality of antenna array elements. A respective one of the terminals of each beam forming array is connected to a respective one of the antenna array elements through a simple junction. The system can produce multiple beams from a single array of antenna elements and is low-loss, and thus appropriate for radar applications, because it obtains isolation between beams by applying orthogonality principles.

10 Claims, 5 Drawing Figures

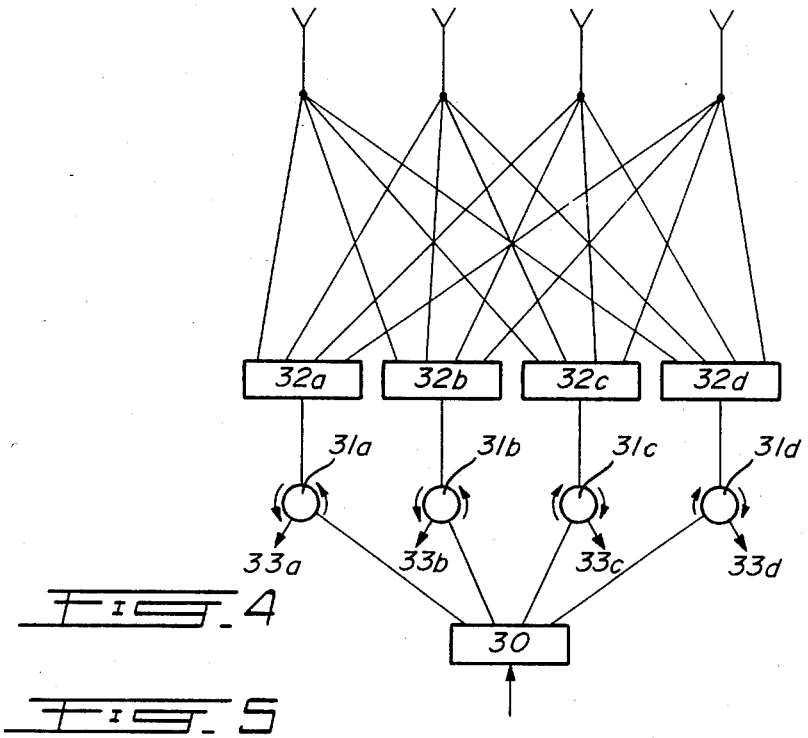
FIG. 4
FIG. 5
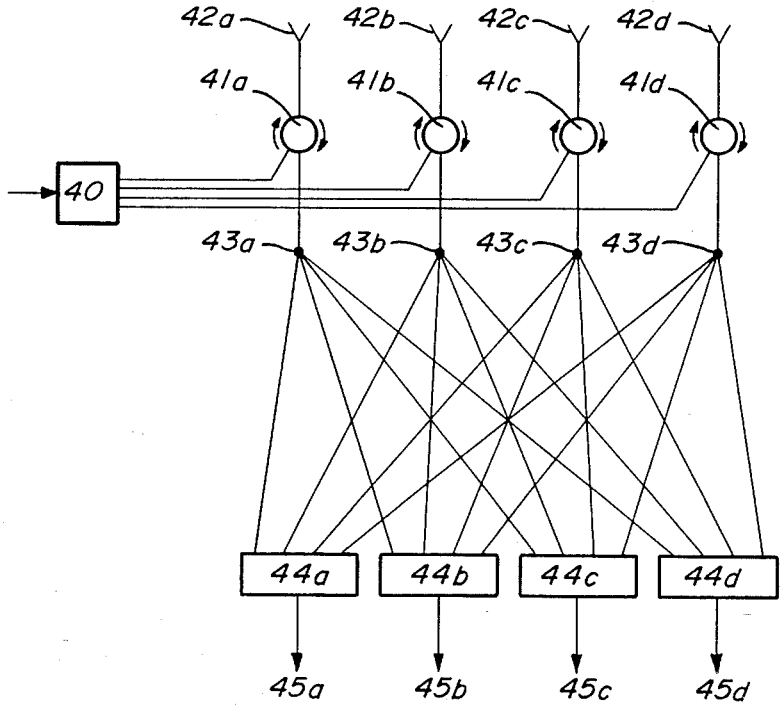

BEAM FORMING ANTENNA SYSTEM

BACKGROUND OF INVENTION

1. Field of the Invention

The invention relates to a beam forming antenna system which provides the capability of producing multiple beams from an array of radiating elements. More specifically, the invention relates to such a system using beam forming networks and simple junctions.

2. Description of Prior Art

In many surveillance radar applications it is desirable to obtain not only the azimuth bearing of a target, but also its elevation angle, which can be used in conjunction with the range to calculate the height of the target. This may be achieved by using separate antennas to obtain azimuth and elevation angles, by using a phased array antenna with a narrow beam which is rapidly scanned in both azimuth and elevation to cover the surveillance area, or by using a multiple beam antenna which produces several beams from the same aperture, such beams typically being stacked above each other or arranged in a suitable three-dimensional arrangement.

This invention is particularly related to a beam forming antenna system including beam forming circuitry coupled to linear, circular, planar or three-dimensional (typically conformal) arrays to supply signals to the antenna elements so that multiple beams are formed on transmit, or to receive signals from the corresponding multiple beams.

The most well known example of prior art is the orthogonal beam forming matrix commonly known as the "Butler Matrix". This produces, for the transmit case, an aperture illumination with uniform amplitude distribution and linear phase distribution corresponding to the selected beam direction. A "Butler Matrix" with N antenna elements (N is normally a power of 2) may have up to N input ports, each corresponding to a beam direction which is orthogonal to (in a mathematical sense) and thus isolated from (in an electrical sense) the other beams. For a transmit/receive antenna, if less than N ports and beam directions are required, the remaining ports may be terminated by matched loads to maintain the properties of the "Butler Matrix". A disadvantage of the "Butler Matrix" is that it produces uniform amplitude aperture illumination for each beam, thus giving a beam with high near-in sidelobes. To overcome this problem "modified Butler Matrixes" have been described which give tapered amplitude distributions, allowing the essential properties of the network to be used for low-sidelobe multiple beam antennas. A further disadvantage of the "Butler Matrix" (and "modified Butler Matrices") is that some of the paths within the matrix cross over, thus making waveguide, stripline and microstrip implementations difficult.

A further example of a prior art beam forming network is given in U.S. Pat. No. 3,868,695, issued Feb. 25, 1975, to E. H. Kadak, which invention uses delay lines, connected to the signal ports by power dividers, and by further power dividers to the antenna elements. The description states that, for an 8 element antenna, an additional 9 dB of insertion loss is introduced, because of the use of matched, isolated power dividers before and after the delay lines (this additional insertion loss is 3 dB for each level of binary splitting in the power dividers). Because of the flexibility introduced by the use of the set of delay lines (typically coaxial cables), this beam forming network is appropriate for use on linear, planar or "conformal" arrays, with uniformly or arbitrarily spaced elements, whereas the "Butler Matrix" is suitable for linear or planar arrays with uniformly spaced elements.

Another example of prior art is the "Rotman Lens" (see, for example, Hansen, R. C. (ed) Microwave Scanning Antennas (Academic Press 1964), Vol. 1, Apertures, pp. 245–246, or, Rotman W. and Turner R. F. Wide-Angle Microwave Lens for Line-Source Applications IRE Trans., AP-11, November 1963, pp. 623–632), which may be used with linear or curved arrays to produce multiple beams in one plane. This has a planar lens structure, which is designed so that it only propagates TEM waves with linear dispersion characteristics. Waves are launched from one side of the lens, from positions corresponding to the required beam directions. Ports on the other side are connected to the array elements by transmission lines which also propagate TEM waves. As a result, the phase lengths of paths from the input ports to the antenna elements vary in proportion to frequency, giving a beam direction independent of frequency. The invention described in U.S. Pat. No. 3,868,695 will also produce beams with directions independent of frequency if it is implemented with power dividers and delay lines having TEM wave characteristics.

Other examples of prior art systems are illustrated in, for example, U.S. Pat. No. 2,817,084, Clapp et al, Dec. 17, 1957, U.S. Pat. No. 3,085,204, Sletten, Apr. 9, 1963, U.S. Pat. No. 3,271,776, Hannan, Sept. 6, 1966, U.S. Pat. No. 3,308,468, Hannan, Mar. 7, 1967, U.S. Pat. No. 3,731,316, Sheleg, May 11, 1973, U.S. Pat. No. 3,736,592, Coleman, May 29, 1973, and U.S. Pat. No. 3,877,014, Mailloux, Apr. 8, 1975.

The '084 patent teaches a junction for feeding antenna elements 31, 32 and 33 through lines 21, 22 and 23 respectively from a main transmission line 24. However, the '084 patent teaches a matching section 25 at the junction of the branch transmission lines 21, 22 and 23 and the main transmission line 24.

In the '204 patent, and especially in FIG. 4, a source is connected to nine antenna elements through various paths which appear to be coupled at simple junctions. However, only a single source is feeding all of the antenna element arrays.

The '776 patent shows an arrangement wherein all of the branch transmission lines 15, 16, 17 and 18 are intercoupled by intercoupling lines 22 to 26. This is for the purpose of impedance matching of array antennas.

The '468 patent, by the same inventor as the '776 patent, shows a plurality of outputs being fed to each one of the elements of an antenna array. However, they are fed to the elements through various hybrid junction devices such as the devices 49 and 50 in FIG. 6.

The '316 and '592 patents include teachings relative to Butler Matrices. The '014 patent includes teaching of a single beam forming circuit 6 which has an output connected to each element of an antenna array.

SUMMARY OF INVENTION

It is an object of the invention to provide a beam forming antenna system which produces multiple beams from the aperture of a linear, circular, planar or three-dimensional antenna array which overcomes the limitations of the prior art systems.

It is a further object of the invention to provide such a beam forming antenna system which is low-loss, and thus appropriate for radar applications, in that it obtains isolation between beams by applying orthogonality principles.

In accordance with the invention there is provided a system which includes a plurality of beam forming networks and a plurality of antenna array elements. Each beam forming network has a plurality of output terminals equal to the plurality of antenna array elements. A respective one of the terminals of each beam forming array is connected to a respective one of the antenna array elements through a simple junction.

BRIEF DESCRIPTION OF DRAWINGS

The invention will be better understood by an examination of the following description, together with the accompanying drawings, in which:

FIG. 4 is a schematic illustration of a further embodiment of the invention; and FIG. 5 is a schematic illustration of a still further embodiment of the invention.

DESCRIPTION OF PREFERRED EMBODIMENTS

Figure 1:
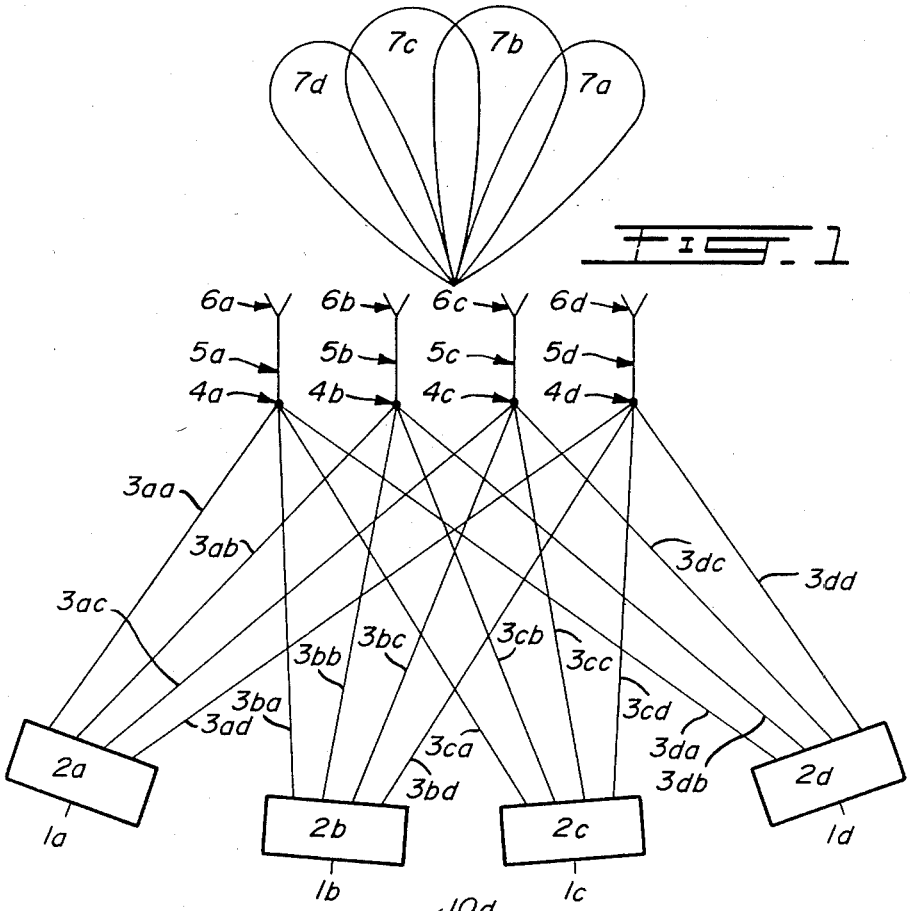
FIG. 1 is a schematic illustration of an antenna system in accordance with the invention.

The basic physical embodiment is shown schematically in FIG. 1 and includes a plurality M of beam forming networks and a plurality N of antenna radiating elements. This will produce a plurality M beams in different directions. The number of beams M may not be greater than the number of radiating elements N. M may however be less than N if coverage is only required over a limited angular range, or in certain specific directions. In the lower limit, M=1 corresponds to a conventional array with a single beam forming network.

Referring now to FIG. 1, for sake of clarity, this illustrates only four beam forming networks 2a, 2b, 2c, and 2d. Each beam forming network has a respective signal transmission line 1a, 1b, 1c and 1d connected to one side thereof, and a plurality of transmission lines connected to the other side thereof. The plurality of transmission lines at the other side is equal to the plurality of array elements N.

The signal transmission lines on both sides of the beam forming network comprise known signal transmission means, for example, waveguides, coaxial cables, or simple conductive wires. The transmission lines are, of course, connected to respective terminals of the beam forming networks.

A respective terminal of each beam forming network is then connected, via the transmission lines, to one side of a respective junction 4a, 4b, 4c or 4d. The other side of the junctions 4a, 4b, 4c and 4d are connected, via transmission lines 5a, 5b, 5c or 5d respectively, to array elements 6a, 6b, 6c and 6d respectively.

In the numbering of the transmission lines between the beam forming networks and the junctions, the first subscript relates to the beam forming network to which the transmission line is connected, and the second subscript relates to the junction to which the transmission line is connected. Thus, 3ac is connected between beam forming network 2a and junction 4c.

The method of operation may be understood by considering both the transmit and receive cases although either of these cases is sufficient to fully specify performance, since the network has only passive components and the principle of reciprocity may therefore be applied.

Consider a signal applied at the input port 1a to the beam forming network 2a. Signals will be produced at the outputs of this network, which are sent along transmission lines 3aa to 3ad to junctions 4a to 4d. Because of the orthogonality of the beam forming illuminations, these signals at the junctions will not be accepted by the other beam forming networks, and will therefore be transmitted along lines 5a to 5d and radiated by elements 6a to 6d to form beam 7a. Similarly, signals at ports 1b, 1c and 1d form beams 7b, 7c and 7d respectively. If signals are applied concurrently at two or more input ports, a set of beams will be formed. These may be separate beams or, by appropriate choice of excitations at the input ports, may combine to form a wider beam of arbitrary shape, e.g. a cosecant-squared beam for use with an air surveillance radar.

If the radiating elements 6a to 6d are not perfectly matched, part of the signals reaching the radiating elements will be reflected back along the transmission lines 5a to 5d to the junctions 4a to 4d. If the radiating elements have identical reflection coefficients, these reflected signals will only be accepted by the originating beam forming network, producing a mismatch at the input port. There will therefore be no coupling to the other beam forming networks unless the radiating elements have differing reflection coefficients, e.g. because of mutual coupling between the radiating elements.

For the receive case, if a signal is received from the direction of the peak of beam 7a, it will cause signals to be transmitted from the radiating elements 6a to 6d, along transmission lines 5a to 5d, to junctions 4a to 4d. The relative phases of these signals at the junctions will be such that they are only accepted by beam forming network 2a, producing an output at port 1a. Similarly, signals received from the directions of the peaks of beams 7b, 7c and 7d will produce outputs at ports 1b, 1c and 1d respectively.

If a signal is received from a direction between two of the beams, this will generate signals at the junctions 4a to 4d which will be accepted by two or more of the beam forming networks. Thus, if a signal is received from a direction between the peaks of beams 7a and 7b, it will produce output signals at ports 1a and 1b, whose strengths are determined by the relative levels of the radiation patterns of beams 7a and 7b in the direction of the received signal. There may also be small outputs from the other ports if their radiation patterns have sidelobes in the direction of the received signal.

The above description of operation, for the transmit case and for the receive case at the peaks of the beams, assumes perfect orthogonality between the beams. This may be possible at one frequency, but will not apply over a finite frequency band. The "Butler Matrix", described in the prior art, maintains orthogonality over a frequency band because the beam directions and width of the main beam and sidelobes all change with frequency, so that the peak of each beam is always aligned with the nulls of the other beams. It thus maintains orthogonality at the penalty of having beam directions which change with frequency. With the present system, the beam directions remain constant, provided that all the components have TEM dispersion characteristics, while the width of the main beam and sidelobes and the positions of the nulls change with frequency. Thus orthogonality only applies at one frequency. For many applications with finite frequency band, which have been designed for orthogonality at or near the middle of the band, there will be sufficient isolation between the channels.

Figure 2:
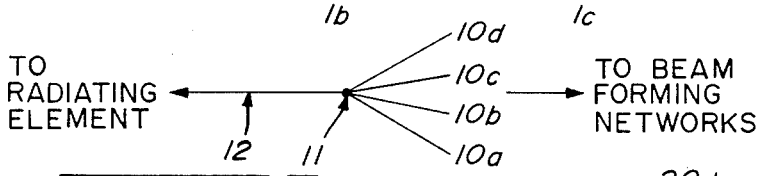
FIG. 2 illustrates a simple junction configuration.

The junctions 4a, 4b, 4c and 4d are, in accordance with the invention, simple junctions as shown in FIG. 2. This is a typical example corresponding to the four beams illustrated in FIG. 1. In FIG. 2, there are four transmission lines 10a, 10b, 10c and 10d connected to one side of the junction 11, and a single transmission line 12 connected to the other side of the junction. All these transmission lines have the same characteristic impedance. The junction is a simple junction in the sense that it does not have any directional properties which might differentiate between the lines 10a to 10d. Thus, if the junction were used by itself, a signal applied to line 12 would divide equally between lines 10a to 10d, with the signals in these lines being in phase with each other. In the complete system, power division at the junctions is determined by the principles which have been described in the preceding paragraphs.

Figure 3:
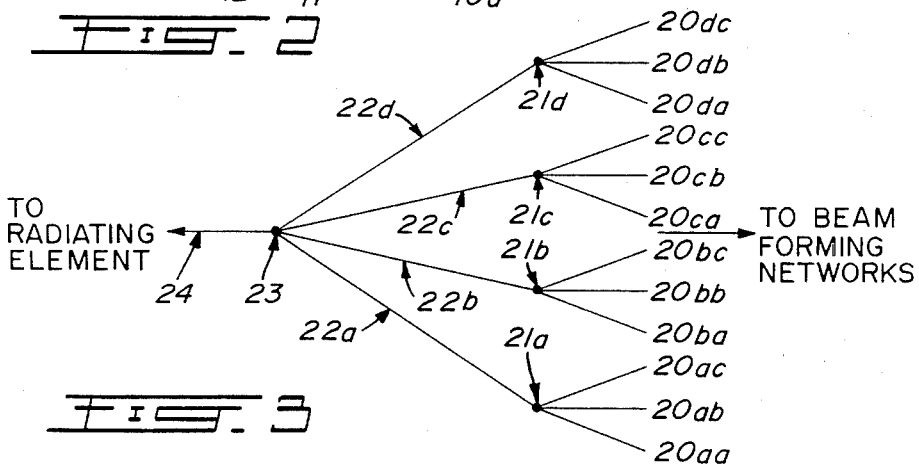
FIG. 3 illustrates an alternative junction configuration.

In practice the configuration of FIG. 2 is only applicable for use with a small number of beam forming networks. It is therefore necessary, when a larger number of beams is required, to consider alternative forms of junctions, e.g. as shown in FIG. 3, which should be considered as a typical but not exclusive method of achieving the required result, and should not be considered to restrict the scope of this invention. Transmission lines 20aa to 20ac, 20ba to 20bc, . . . , 20da to 20dc connect the beam forming networks to simple junctions 21a to 21d. These junctions are then connected by further transmission lines 22a to 22d to simple junction 23, which is in turn connected by transmission line 24 to the corresponding radiating element. All the transmission lines have the same characteristic impedance. The length of transmission lines 22a to 22d is chosen to be one half-wavelength, in the transmission line medium, at the design frequency. Then, by standard transmission line theory, the lines 20aa to 20ac, . . . , 20da to 20dc all appear to be connected directly to junction 23, at the design frequency. At other frequencies in the band, the length of lines 22a to 22d will no longer be one half-wavelength. This will cause some coupling between the beams, and will therefore limit the bandwidth of the network. For even larger numbers of beams, it may be necessary to add additional sets of junctions and intermediate transmission lines, which will further limit the bandwidth. While the use of this alternative form of junction causes some coupling between beams, this may be limited by appropriate choice of connection arrangement, for example the designer may minimize coupling between adjacent beams by connecting their beam forming networks to the same node of the junction. It should be noted that, although this alternative configuration has superficial similarity with the prior art, it is still essentially different from the prior art in that it does not use isolated power dividers between the radiating elements and the beam forming networks.

It may be desirable for the antenna of an air-surveillance radar to transmit a single beam with cosecant-squared shaping in the elevation plane, but to receive from multiple elevation plane pencil beams, to obtain an indication of the height of targets. Another possibility is that the antenna may transmit with the shaped beam, but receive with both the shaped beam, to give primary target detection, and with the multiple pencil beams to give height information. These possibilities are achievable with adaptations of this invention, which are shown in FIGS. 4 and 5. For these applications the network may feed radiating elements which are horizontal linear antennas with narrow azimuth plane beamwidths.

In FIG. 4, an additional network 30 is connected through circulators or duplexers 31a to 31d to the beam forming networks 32a to 32d. Network 30 gives outputs corresponding to the relative amplitudes and phases of the beams which will combine to form the shaped transmitted beam. It therefore differs from the beam forming networks 32a to 32d, which give illuminations to the individual array elements. On reception, the outputs from beam forming networks 32a to 32d are routed by the circulators or duplexers 31a to 32d to outputs 33a to 33d, which correspond to each of the multiple beams.

If detectability is the main criterion, and height-finding a secondary consideration, then directional couplers can be used for 31a to 31d, instead of circulators or duplexers, with the main arms being connected to network 30 and the coupled arms to outputs 33a to 33d. Operation on transmit is similar to that described above. On reception, the major part of the signal goes to network 30 for target detection, with smaller signals coupled to outputs 33a to 33d giving elevation information.

FIG. 5 shows an alternative configuration. In this case the additional network is a true beam forming network. On transmit, signals from beam forming network 40 are connected by circulators or duplexers 41a to 41d to the radiating elements 42a to 42d. On reception, signals from the array elements 42a to 42d are routed via circulators or duplexers 41a to 41d and simple junctions 43a to 43d to beam forming networks 44a to 44d, giving outputs 45a to 45d. Again, if detectability is more important than height-finding, directional couplers can be used at 41a to 41d instead of circulators or duplexers. The major part of the received signal is then routed to network 40, with smaller outputs from ports 45a to 45d. If, in a particular application, it was desirable to detect targets over a wide angular region, but specific elevation information was only necessary for certain parts of this region, the above arrangement would allow this by using a limited number of beams which do not cover the full extent of the shaped transmitted beam.

In summary, the outputs from each of the beam forming networks are connected together at simple junctions behind each of the radiating elements of the array. Each junction comprises lines from each of the beam forming networks and a line to the radiating element, all such lines having the same characteristic impedance. The antenna should be configured so that the electrical line lengths from the junctions to the radiating elements are identical. The differential line lengths, which are required to produce beams in different directions, are therefore included in the beam forming networks (which are considered to include the lines to the junctions). The beam forming networks should be designed to produce beams which are orthogonal to each other.

When a signal is applied at the input port of one of the beam forming networks, this generates signals with specified amplitudes and relative phases at each of the junctions. Because of the orthogonality relationship between the networks, these signals will not be accepted by the other beam forming networks, and will therefore be radiated from the elements of the array, forming a beam in the required direction. If all components of the beam forming networks and connecting transmission lines have linear phase variation with frequency, the direction of the beam relative to the aperture will not change with frequency.

The essential improvement introduced by this invention is the use of simple junctions behind the radiating elements, and the use of the orthogonality principle to provide isolation between the beams. In the prior art (U.S. Pat. No. 3,868,695) this was provided by means of matched, isolated power dividers between the radiating elements and the beam forming networks, which dissipated the majority of the power in resistive loads. This resulted in a large additional insertion loss, typically an extra 9 dB for an 8 element array, which made the arrangement unsuitable for use except at low power levels. This additional insertion loss is not present in this invention.

Although several embodiments have been described, this was for the purpose of illustrating, but not limiting, the invention. Various modifications, which will come readily to the mind of one skilled in the art, are within the scope of the invention as defined in the appended claims.

I claim:

1. A beam forming antenna system, comprising:

an antenna array comprising a plurality of N antenna array elements, each antenna array element having associated therewith a signal transmission line;

a second plurality M of beam forming networks, each of said beam forming networks having a first terminal on one side thereof and a plurality of N second terminals, equal to said first plurality, on the other side thereof;

a signal transmission line connected to each of said second terminals;

the transmission line of all Nth terminals of each said beam forming networks being connected to the Nth antenna array element through a simple junction means;

said simple junction means comprising a junction point, said signal transmission line associated with said respective antenna array element being connected to one side of said junction point, said signal transmission lines from the Nth terminals of all beam forming networks being connected to the other side of said junction point, all of said signal transmission lines having the same characteristic impedance;

whereby, application of a signal to any one of said beam forming means to the first terminal thereof will form a beam which is radiated by said array in a predetermined direction, which predetermined direction is different and isolated from other predetermined directions of the beams formed by application of said signal to any other ones of said beam forming network, such isolation being achieved by the mathematical orthogonality of the signals applied at the simple junction means; and whereby, signals received from one of said predetermined directions will be applied only to the beam forming network associated with that direction; signals received from a direction different from said predetermined directions being divided proportionately amongst all of said beam forming networks.

2. A system as defined in claim 1 and further including a plurality M of directional means, each directional means having a first terminal on one side thereof and a second and third terminal on the other side thereof;

said system further including a further network having a first terminal on one side thereof and a plurality of M terminals on the other side thereof;

the first terminal of each directional means being connected, by a transmission line, to the first terminal of a separate one of said beam forming networks;

the second terminal of each directional means being connected, by a transmission line, to a different one of said plurality of terminals of said further network means;

wherein, a signal to be transmitted is applied to the first terminal of said further network means; and whereby, output received from a different one of said predetermined directions will appear at the third output terminal of a respective one of said directional means.

3. A system as defined in claim 2 wherein said directional means comprise directional couplers.

4. A system as defined in claim 2 wherein said directional means comprise duplexers.

5. A system as defined in claim 2 wherein said directional means comprise circulators.

6. A system as defined in claim 2 wherein said further network means provides outputs corresponding to the relative amplitude and phases of beams which combine to form a shaped transmitted beam.

7. A system as defined in claim 1 and further including a plurality N of directional means, each of said directional means having a first terminal on one side thereof and a second and third terminal on the other side thereof;

said system further including a further beam forming network having a plurality N of output terminals and an input terminal;

each directional means being disposed in circuit between a respective one of said junctions and its associated antenna array element such that the first terminal is connected to said antenna array element by a transmission line and the second terminal is connected to the respective junction by a transmission line, the third terminal of each directional means being connected, by a transmission line, to a respective one of the output terminals of said further beam forming network;

wherein, a signal to be transmitted is applied to the first terminal of said further beam forming network; and wherein, the first terminals of said M beam forming networks comprise the output for received signals.

8. A system as defined in claim 7 wherein said directional means comprise directional couplers.

9. A system as defined in claim 7 wherein said directional means comprise duplexers.

10. A system as defined in claim 7 wherein said directional means comprise circulators.

* * * * *

UNITED STATES PATENT AND TRADEMARK OFFICE

CERTIFICATE OF CORRECTION

PATENT NO. : 4,721,960

DATED : January 26, 1988

INVENTOR(S) : Andrew John Lait

It is certified that error appears in the above-identified patent and that said Letters Patent is hereby corrected as shown below:

Column 6, line 15 change "32d" to

--31d--

Signed and Sealed this

Thirteenth Day of June, 1989

*Attest:*

*Attesting Officer*

DONALD J. QUIGG

*Commissioner of Patents and Trademarks*